US005833378A

United States Patent [19]

Gibson

[11] Patent Number: 5,833,378

[45] Date of Patent: Nov. 10, 1998

[54] COLLAPSIBLE TYPING KEYBOARD TRAY

[76] Inventor: Marc E. Gibson, 2840 Colby Dr., Boulder, Colo. 80303

[21] Appl. No.: 654,902

[22] Filed: May 29, 1996

[51] Int. Cl.[6] ..... B41J 5/10

[52] U.S. Cl. ..... 400/472; 248/118.3; 248/918; 400/715

[58] Field of Search ..... 400/472, 715; 248/118, 118.3, 918

[56] References Cited

U.S. PATENT DOCUMENTS

| | | | |
|---|---|---|---|
| 1,560,020 | 3/1925 | Curley | 434/227 |
| 2,053,874 | 9/1936 | O'Donnell | 434/227 |
| 3,501,849 | 3/1970 | Olsen | 434/233 |
| 4,580,984 | 4/1986 | Madaus | 434/227 |
| 4,779,922 | 10/1988 | Cooper | 248/918 |
| 4,940,346 | 7/1990 | Liljenquist | 400/487 |
| 5,067,834 | 11/1991 | Szmanda et al. | 400/489 |
| 5,137,384 | 8/1992 | Spencer et al. | 400/715 |
| 5,145,270 | 9/1992 | Darden | 400/488 |
| 5,269,689 | 12/1993 | Hill | 434/227 |
| 5,351,897 | 10/1994 | Martin | 244/118 |
| 5,360,280 | 11/1994 | Camacho et al. | 400/472 |
| 5,405,204 | 4/1995 | Ambrose | 400/472 |
| 5,513,824 | 5/1996 | Leavitt et al. | 400/715 |

OTHER PUBLICATIONS

*Harvard Dictionary of Music*, Second Edition, by Willi Apel, pp. 675–677.

*Great Pianists Speak For Themselves*, by Elyse Mach.

*Famous Pianists & Thier Technique*, by Reginald R. Gerig, pp. 128–137, 328–341, 404, and 405.

"Proformix™" by Advanced Ergonomics, Minneapolis, MN—Brochure.

"Typing Without Keys", *Newsweek*, Dec. 7, 1993, pp. 63–64.

"Situs Office Ergonomics", Arvada, CO—Brochure.

*Primary Examiner*—John S. Hilten
*Assistant Examiner*—Leslie Grohusky
*Attorney, Agent, or Firm*—Rick Martin

[57] ABSTRACT

A collapsible keyboard support tray has folding legs. The legs have risers to enable adjustment of the deck to a height so that the hinged tray depends at an approximate negative 25°. The deck has a height to support a wrist pad at just below the user's wrist to enable typing with a zero degree angle from the wrist to the forearm. The user adjusts his chair to create a 90° angle from his forearm to his upper arm during typing.

6 Claims, 3 Drawing Sheets

COLLAPSIBLE TYPING KEYBOARD TRAY

FIELD OF INVENTION

The present invention relates to an apparatus to relieve repetitive strain injury (RSI) on typing keyboards. The apparatus supports the keyboard at a negative angle. An optional method improves upon a piano technique called weight touch wherein the natural falling weight of the whole arm is used to depress the key.

BACKGROUND OF THE INVENTION

Two main features of modern typing keyboards needed to reduce RSI are the proper forearm angle relative to the keyboard and the proper negative slope of the keyboard. Support for an ideal 90° angle of the forearm relative to the upper arm comes from a 1951 study by Ellis. The home row of the keyboard should be at elbow height.

The next key feature of a proper RSI relieving system is a negative slope of the keyboard at an approximate 25° angle. Modern keyboards having these two features have the keyboard support trays built into a drawer. The keyboard folds into the drawer for storage. For typing, the keyboard is tilted into a negative angle after the drawer is pulled out. A representative system is made by Situs Office Ergonomics of Arvada, Colo. (U.S. Pat. No. 5,351,897 to Martin). Situs does recommend the use of a wrist rest while typing which is opposite the teaching of the present invention. Situs also recommends an elbow angle over 90° which is opposite the teaching of the present invention.

Another relevant system having a level keyboard is made by Advanced Ergonomics of Minneapolis and trademarked as Proformix™, U.S. Pat. No. 5,351,897. This system comes with a palm rest which is designed to support the palm during typing.

Supporting the palm during typing is not the most relaxing position for typing because the extensor muscles are used to strike the keys. The present invention teaches the proper method to strike the keys is to use a weight touch method.

Below follows a brief summary of the known art in methods to strike a keyboard of either the piano or computer type.

Harvard Dictionary of Music, 2nd Ed., Willi Apel, teaches that in piano playing, one method of striking the keys is using arm action in which the whole arm moves from the shoulder, thus, enabling the hand to rise vertically above the keys and then drop. This method is used for loud passages. The method is executed by relaxing the muscles and using the weight of the arm.

Great Pianists Speak For Themselves. Dodd, Mead & Co, NY, by Elyse Mach, discloses that Claudio Arrau (and originally Liszt) uses a method wherein the arms should be like snakes, so that together with loose wrists there would be no interruption of the flow of movement anywhere.

Other artists called the method the "weight touch" method using controlled relaxation in only a few muscles and joints. "Relaxed weight" is another description dating back to 1892. Other descriptions include relaxation, rising the massive weight of the arms, play from the shoulder, fore-arm rolling, and slung fingers and a dropping hand.

U.S. Pat. No. 1,560,020 (1925) to Curley discloses a typewriter touch typing device which hides the identity of selected keys.

U.S. Pat. No. 2,053,874 (1936) to O'Donnell discloses a touch typing teaching chart.

U.S. Pat. No. 3,501,849 (1970) to Olsen discloses a typewriter teaching method using color coded keys, color coded finger rings, and a booklet.

U.S. Pat. No. 4,580,984 (1986) to Madaus discloses a typewriter teaching method using a simulated keyboard having finger positions indicated.

U.S. Pat. No. 4,940,346 (1990) to Liljenquist discloses a modified keyboard having visual patterns and tactile patterns.

U.S. Pat. No. 5,269,689 (1993) to Hill discloses a typing method where the elbows are rested against the body, thus, not utilizing a full arm weight method of touching the keys. Four basic patterns of finger movement speed up learning to type.

U.S. Pat. No. 5,351,897 (1994) to Martin discloses an under the desk bracket having a keyboard tray. The tray can be adjusted to a negative sloping angle. A palm support is provided.

A key feature of a proper RSI relieving system is a negative slope of the keyboard at an approximate 25° angle. Modern keyboards having this feature build the keyboard support tray into a drawer. See the Situs system. The keyboard folds into the drawer for storage. For typing, the keyboard is tilted into a negative angle after the drawer is pulled out.

Nobody has modified the piano method of weight touch also known as "playing from the shoulder" to a computer keyboard. A computer keyboard has a plurality of keys each activating a sensitive micro switch. Modern micro switches require far less force to impact as compared to a piano keyboard. Thus, it may have been thought an inappropriate technique for computer keyboards.

As described in the *Harvard Dictionary of Music,* "arm action" can be used for creating powerful fortissimo chords. However, Harvard also teaches that rapid passages can also be played by minimized finger action with a transfer of the arm's weight from one finger to the next. This is the "minimal movement" technique and is the basis of the present invention's computer key board adaptation. This is noted as the basic technique of truly accomplished piano playing.

The R.S.I. epidemic of tendonitis and carpal tunnel syndrome has become a widespread and serious problem since the computerization of the workplace. The method and device presented here constitute an adaptation of a classical piano technique known as long ago as the 1700's.

There is a precedent established in the ergonomic field of Music Therapy. Pianists get tendonitis from playing by the "Finger Technique" and are cured when taught the "Arm Weight Technique." The pedigree of the Arm Weight Technique is impressive. Mozart taught it to Beethoven, from whom it passed to Czerny, to Lizst, to Chopin, to Leschetizsky, to Schnabel, to the late Rudolf Serkin, and from his generation of Schnabel students, to many great current players, Alfred Brendl, Mischa and Cipa Dicther, Andre Watts, and many more.

The finger method teaches us to keep the wrist low, the knuckles high and lift each finger like a hammer to strike the keys. This method fights gravity by angling the hand upwards from the wrist and lifting the fingers up from there. The finger does a lot of work, and tendonitis can occur.

The arm weight technique depresses the key by dropping arm weight through the finger. The wrist is held higher than the knuckles by an inch or more; the fingers stay low, close to the keys. Striking a key starts in the biggest muscles of the arm, shoulder, and trunk, and ends with the small finger muscles. The hand angles down from the wrist, so gravity is fought by the big arms rather than by the hand angled upward from the wrist. The finger finds the key, and the arm drops weight on it. The finger does much less work. The stress which was isolated in the finger in the other method, is distributed over the big arm, shoulders, and trunk muscles. The result is a very relaxed technique, which is much less stressful to the tendons.

Virtuosity in the arm weight school consists of mastering the "Minimal Movement Technique". Dropping weight on keys can be done with a minimum of actual movement. Learning the minimum relaxed effort required to play is the "Trade Secret" which I am applying to this effort. Less movement means less tendon irritation.

Tendonitis and Carpal Tunnel Syndrome are caused by irritating the tendons as they move inside the Synovial sheath lubricated by Synovial fluid. If they are bent, strained, used roughly or too repetitively, they swell or form scar tissue. This jams the Synovial sheath and the Carpal Tunnel causing reduced circulation, nerve pinching, or nerve damage. This method and device have brought relief to patients diagnosed with tendontitis and Carpal Tunnel.

The tilted keyboard, that is a keyboard sloped negatively downward at 25° or 30° with the spacer bar higher and the numbers row lower, is designed to reduce overuse and straining of the "Extensor muscles" and tendons. The extensors are the weakest of the hand and finger muscles. They are the muscle set which extend the fingers out straight. Their complement, the flexor muscle set are the strong gripping muscles which are used to form a fist. The horizontal or upward sloped keyboard forces the typist to fight gravity all day with the weakest muscles, the extensors.

As an experiment, hold your right hand out flat, palm down, and push down with the left hand on the fingers of the right. Feel the weak extensor muscles and tendons holding up the pressure of the left hand. These muscles fight gravity all day, and become exhausted doing so. Now turn the right hand palm up, and press down on the fingers with the left. The flexor muscles are many times stronger than the extensors.

In the negative slope position, the fingers are not held parallel to the floor, but are allowed to slant downward from the knuckles to the keys on the sloped keyboard. This way, the inexorable force of gravity is fought with the bigger forearm and arm muscles, not the weak finger extensors.

Any method which rests the wrists and types from there strains the extensors. The best solution seems to be to share the stress with the biggest available muscle sets; the arms, shoulders, and trunk as do the piano virtuosos.

Elbow Angle

The most recent ergonomics publications advocate an elbow angle between 90 and 103 degrees for any hand-based work. Tests show that accuracy is best in this range. More acute angles tire the arm, and more obtuse angles cause circulation problems which make tendons swell and toxins accumulate unable to circulate back out of the hand properly. The hand should be half full and half empty of blood.

Wrist Angle

Ergonomics recommend either that the wrist be held in a straight line with the forearm, or that the top knuckles be allowed to rise up by about ½ to ¾ of an inch. Both positions work well with this method.

Finger Angle

The fingers drop from the knuckle to land on the sloped keyboard below at an angle of 60 to 70 degrees from the forearm, which is parallel to the floor. Each finger is curved and rests on the "home row" GH.

At this point, we teach arm weight piano technique.

In the old method with the low wrist, high knuckle, high finger, and finger hammering, each finger operates independently from the other fingers, hand, wrist, arm, and so on. The finger does too much work. It strikes the key, struggling somewhat against the rest of the hand. This causes friction and tendon irritation.

In the new method, the key is depressed by dropping arm weight on it. In this way, the whole combination of finger, hand, wrist, arm, elbow, and shoulder operate as a holistic unit. This is relaxing for the tendons. Small finger muscles move with the large arm muscles. The movement starts in the large arm muscles and ends in the small finger muscles. The finger locates the key and the arm drops on the key, relaxes weight on it.

Experiment: With the right index finger, type the old typing exercise, "J U J M" in the new position, dropping arm weight on the keys instead of striking them with the finger muscles. Move the arm and elbow forward to press "U" and move the elbow back to press "M". The whole arm moves to each key, then drops on it. This greatly reduces the demands on the finger and distributes the stress evenly along the whole arm, shoulder, and trunk.

Repeat the exercise with all fingers of both hands. For example, right middle finger types, "K I K comma" and right ring finger types "L O L period", etc. Move the whole arm forward and back toward far or near rows of keys. Relax as much as possible.

Most people report greater relaxation and an increase in accuracy and in speed because the position is more natural, and comfortable.

Virtuosity, The Minimal Movement Technique

Type from your back, your belly, your legs. The arms and hands become more relaxed and more a part of a totality of coordination.

Arm weight piano virtuosos keep their fingertips low or in contact with the piano keys, like a touch typist touching the keyboard. Weight drops with an almost imperceptible movement.

Focus on one key. Observe how little effort is really required to depress it, how little weight. Observe how small a distance it moves and how relaxed the hand and arm can be to activate it. Any extra movement is just wearing out you hand.

The three principles of virtuosity are these:

1. Minimal movement.
2. Maximum relaxation.
3. Let gravity do the work. You just direct gravity.

The Wrist Rest

The wrist rest is included to encourage frequent breaks. Ergonomists recommend major breaks every 45 minutes.

The 90 degree elbow position can irritate the Extensor Tendon at the top of the forearm by the elbow to the point of tendonitis and surgery. Arm weight typing doesn't isolate this tendon as much, but resting any time you are not typing is wise. The present method recommends resting on the wrist rest in a relaxed fist with the thumbs up. This promotes good circulation in the Carpal Tunnel.

Some Ergonomists do not recommend typing while resting the wrist because this cuts off blood flow. It also isolates and strains the extensor muscles. The present method is designed not to isolate any muscle but to redistribute stress along the bigger muscles.

Regarding the claimed apparatus herein, all surfaces and angles on the tilter device are adjustable to suit the various keyboards and various needs of the individual. It is designed to fold flat to fit under a keyboard in a drawer when not in use.

The present invention relieves computer keyboard RSI by providing a simple folding keyboard tray which supports the use of the piano's known "arm weight and minimal movement" technique.

SUMMARY OF THE INVENTION

The main aspect of the present invention is to provide a simple folding keyboard support tray which supports the keyboard at a 25° negative angle.

Another main aspect of the present invention is to support the tray at a height which provides a 90° angle of the forearm to the upper arm.

Another main aspect of the present invention is to provide support for a wrist rest used only during break periods. The wrist rest of this system is not used during typing.

Other objects of this invention will appear from the following description and appended claims, reference being had to the accompanying drawings forming a part of this specification wherein like reference characters designate corresponding parts in the several views.

The preferred embodiment is a keyboard stand having an upper deck to support a wrist rest pad just beneath the height of the wrist during typing. The deck's height is adjustable to adjust the negative angle of the support tray. The whole device folds flat for storage.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 8:
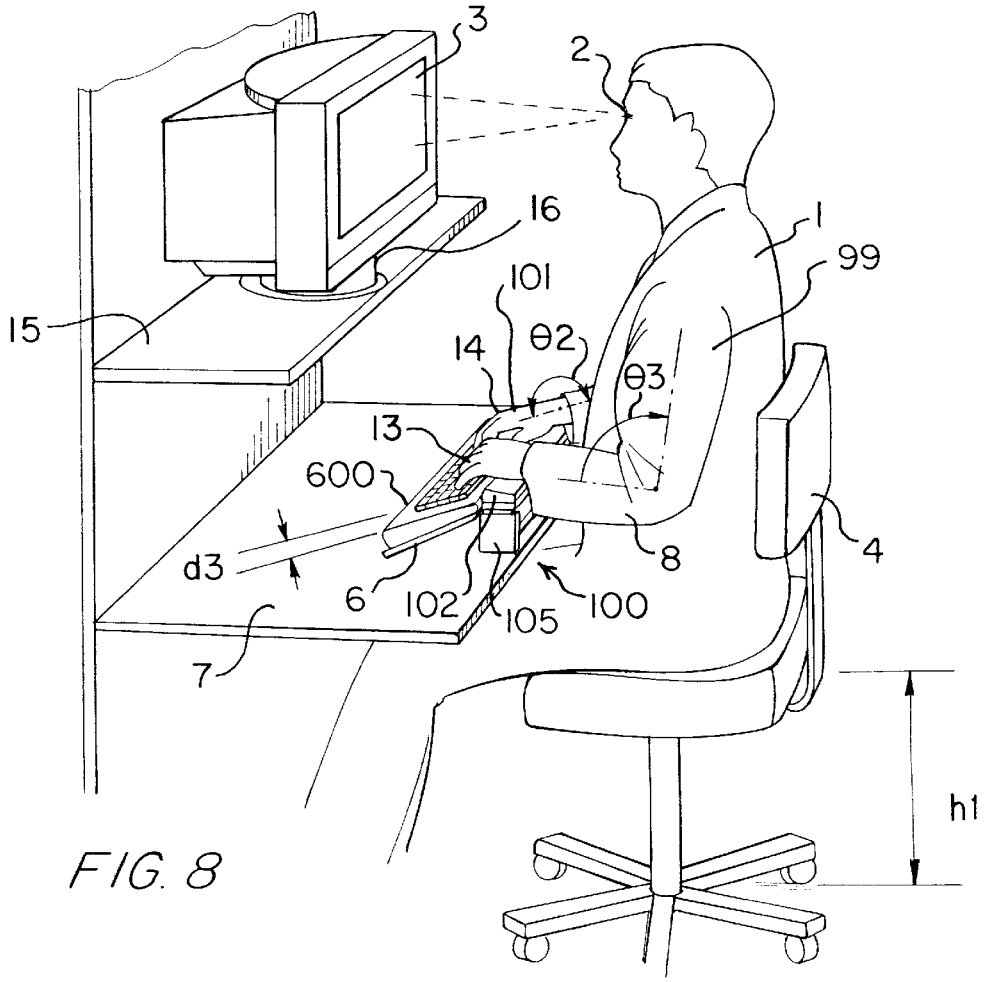
FIG. 8 is a side perspective view of a user typing using the tray of FIG. 1.

Referring first to FIG. 8 a computer user 1 has eyes 2 which are at the same height as screen 3. Chair 4 is adjustable to height h1 to allow for the proper height of the eyes 2. The computer screen 3 has a base 16, and an adjustable support structure 15 to allow the computer user 1 to further adjust the height of screen 3. The user 1 has removed all jewelry from his hands 14 and arms 8. The user 1 is sitting in an upright, not slouched, posture. The user 1 will take minor work breaks for a minute or two whenever he feels discomfort. He will take a major work break of up to ten minutes every forty-five minutes all day long.

The user's forearm 8 is at a 90° angle (θ3) to his upper arm 99. The keyboard tray 6 is supported on a solid surface 7. Angle θ2 is 180° between the forearm 100 and the wrist 101. The striking fingers 13 are all curved at all their joints, thereby enabling striking of the keys on the keyboard 600.

The preferred method steps for typing as shown in FIG. 8 are:

positioning a computer screen at eye level;

maintaining an upright sitting posture;

positioning a computer keyboard at desk height to provide a 90° angle of the typist's elbows;

curving all four striking fingers of each hand at their joints, thereby enabling the finger tips to strike the keyboard keys;

adjusting to the proper key position by moving the hands with the upper torso and large arm muscles, allowing the proper finger to locate the desired key;

depressing the chosen key by controllably dropping a portion of the arm weight through the key finger by using the upper torso and large arm muscles;

relaxing the hand during key depression and resisting excess gravitational forces by the use of the torso and large arm muscles;

repeating the above steps for each key stroke and controlling the upward motion of the hand to less than half an inch; and achieving touch typing virtuosity by creating a fluid oneness of relaxed, minimal movement of the torso, arms, wrists, hands, and fingers.

Elbow Angle

The most recent ergonomics publications advocate an elbow angle between 90 and 103 degrees for any hand-based work. Tests show that accuracy is best in this range. More acute angles tire the arm, and more obtuse angles cause circulation problems which make tendons swell and toxins accumulate unable to circulate back out of the hand properly. The hand should be half full and half empty of blood.

Wrist Angle

Ergonomics recommend either that the wrist be held in a straight line with the forearm, or that the top knuckles be allowed to rise up by about ½ to ¾ of an inch. Both positions work well with this method.

Finger Angle

The fingers drop from the knuckle to land on the sloped keyboard below at an angle of 60 to 70 degrees from the forearm, which is parallel to the floor. Each finger is curved and rests on the "home row" GH.

The tilted keyboard is for touch typists only. It affords the least tendon strain of any position. Combine this angle with the relaxed weight dropping and minimal movement technique noted above, and you have the preferred mode of the present invention.

Figure 7:
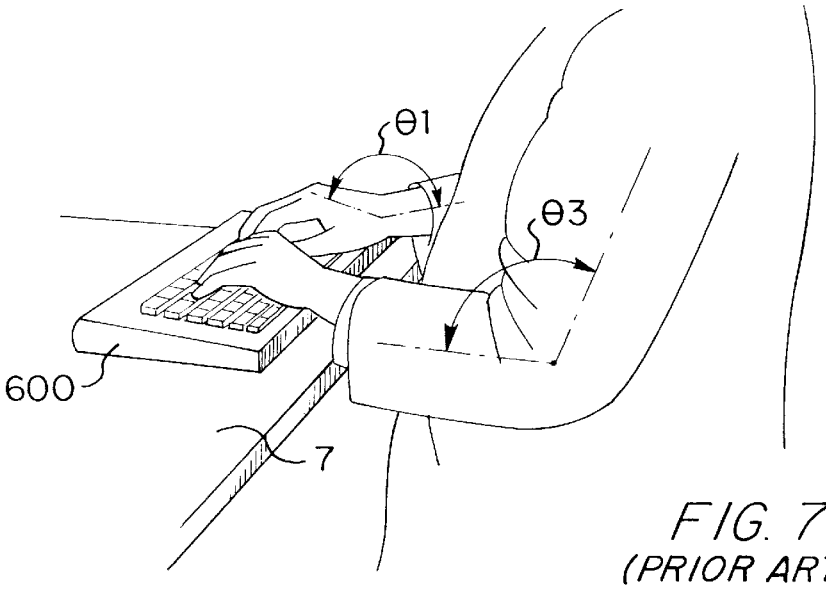
FIG. 7 (PRIOR ART)
FIG. 7 (prior art) is a side perspective view of a flat keyboard.

FIG. 7 shows how the traditional arrangement of the keyboard 600 on the same surface 7 causes the user's wrists to create an upward angle θ1 relative to the forearm. This is true even when the proper 90° angle occurs at θ3. The angle θ1 causes the user to work the extensor muscles which results in RSI. The present invention shown in FIG. 8 results in the angle θ2 being 180°, so that the wrists are flat. Here the flexor muscles are used, thus relieving RSI.

Figure 1:
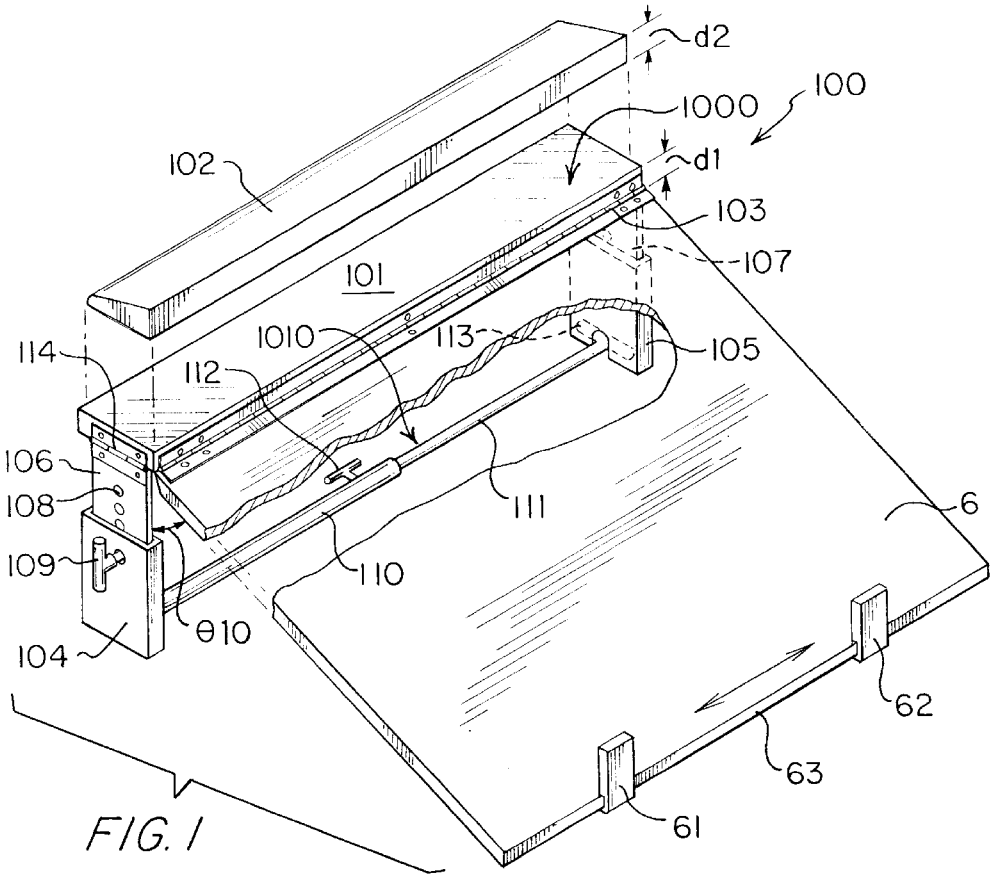
FIG. 1 is a top perspective view of the preferred embodiment, the collapsible typing keyboard tray.
Figure 2:
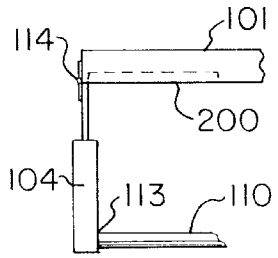
FIG. 2 is a side plan view of one leg of the tray of FIG. 1.

Referring next to FIG. 1 the collapsible tray 100 is the preferred embodiment. A deck 101 supports a wrist rest 102 just below the user's palm during typing. As best seen in FIG. 8, this equates to the wrist rest being about ½ inch above the keyboard surface, d3=½ inch. To accomplish this, the tray 6 is hinged at 103 to the deck 101. Thus, the deck 101 has an upper support surface 1000 that extends about ½ inch above the tray 6, d1=½ inch. The standard wrist rest is ¾ inch thick, d2=¾ inch.

Leg bases 104,105 each have risers 106, 107 which provide for adjusting the angle θ10 to the user's choice of approximately 25° negative angle. The spring-loaded locking handle(s) 109 locks into the desired hole 108.

Figure 3:
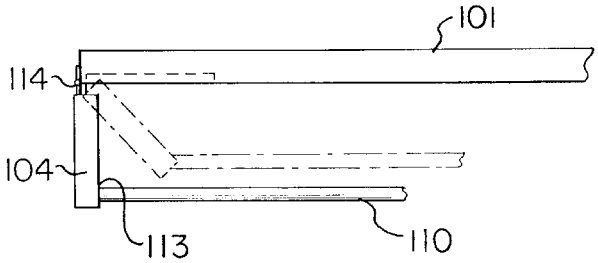
FIG. 3 is the same view as FIG. 2 showing the leg partially folded.

The hinge(s) 114 enables the leg assembly 106,109 to collapse under the deck 101. The telescoping support bar 1010 comprises members 110, 111 and spring loaded locking handle 112 to collapse under the deck 101 as best seen in FIG. 3.

Figure 4:
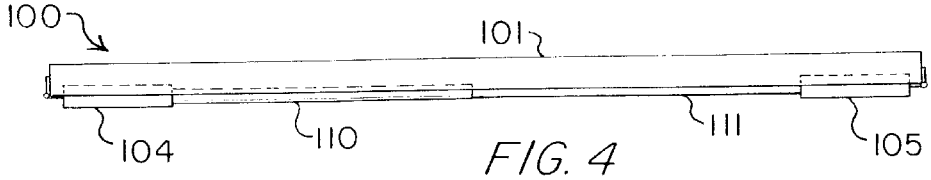
FIG. 4 is a side plan view of the tray folded.

The keyboard, rests 61, 62 slide along distal edge 63 of tray 6. They also fold flat for storage as seen in FIG. 4. The deck 101 has cutout(s) 200 to receive the leg base 104 in the collapsed mode shown in FIG. 4.

Figure 5:
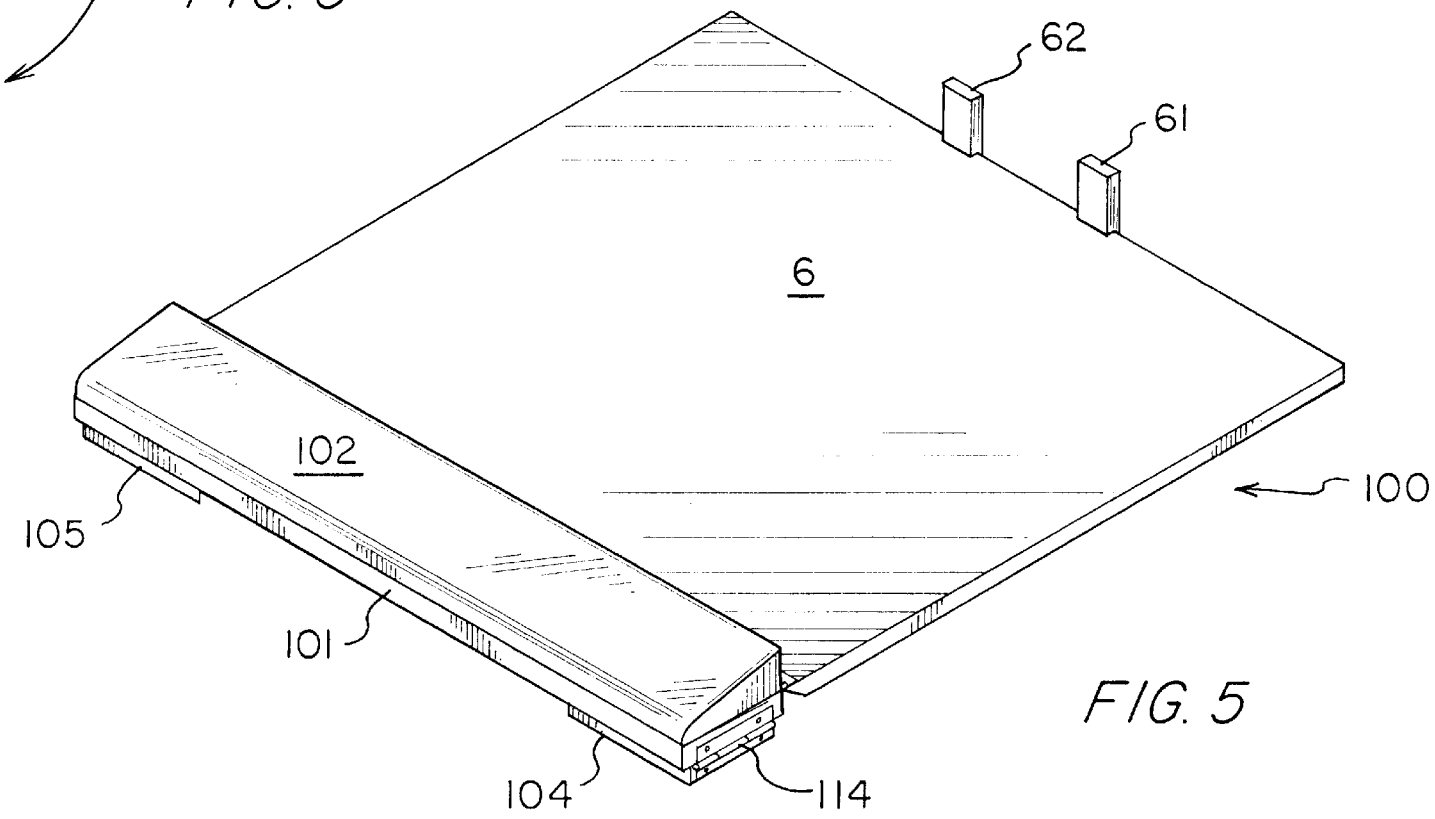
FIG. 5 is a top perspective view of the tray with the legs folded.
Figure 6:
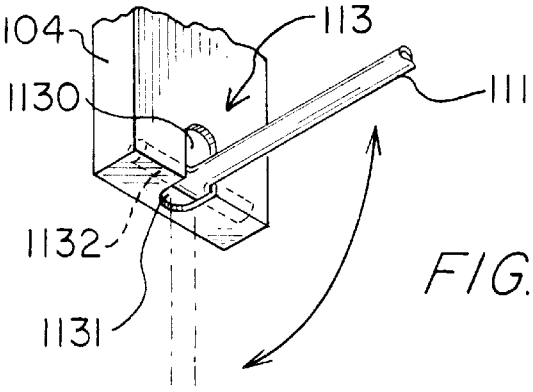
FIG. 6 is a close-up view of the hinge at the bottom of the leg.

Referring next to FIGS. 5, 6 the hinge 113 is shown to consist of right-angle cutouts 1130, 1131. Member 111 is pivotally supported by pin 1132 inside the cutouts 1130, 1131. FIG. 5 shows the collapsible tray 100 with the leg assemblies folded so the collapsible tray will fit in a drawer.

I claim:

1. A collapsible keyboard support tray comprising:

a deck having leg assemblies;

said leg assemblies each further comprising:

a base and a riser means functioning to adjust a height of the deck above a support surface;

a keyboard support tray having a hinge means functioning to maintain a top surface of the keyboard support tray approximately ½ inch below the deck and at an approximate 25° negative angle away from a user;

a wrist rest means removably mounted atop the deck functioning to allow a 180° degree angle from a user's hands to his forearm;

a telescoping support bar means functioning to stabilize the leg assemblies and fold under the deck in a collapsed mode; and said riser means each further comprising a hinge means functioning to fold the riser means under the deck in the collapsed mode.

2. The apparatus of claim 1, wherein the riser means further comprises a sliding panel having adjustment holes for a locking handle on the base to engage the sliding panel.

3. The apparatus of claim 1, wherein the deck further comprises a cutout for a receiving base in the collapsed mode.

4. In combination with a support surface and a chair having a height adjustment means and a support means for a computer screen, an improvement comprising:

a means to position the computer screen at eye level;

a collapsible keyboard stand having a location atop the support surface;

said collapsible keyboard stand having a keyboard and a means to adjust a negative angle of approximately 25°, said means to adjust further comprising a hinge, a deck which supports a pair of leg assemblies, and a telescoping support bar means functioning to stabilize the leg assemblies and fold under the deck in a collapsed mode;

said height adjustment means enabling a user to maintain a 90° angle between his forearm and upper arm during typing on the keyboard; and said collapsible keyboard stand further comprising a wrist pad supported at a height just below the user's wrists, thereby enabling a 180° angle from the user's wrists to his forearms.

5. The improvement of claim 4, wherein the means to adjust a negative angle of approximately 25° further comprises said pair of leg assemblies each having a riser section to provide an adjustable height for said deck, said deck having a hinged keyboard support tray.

6. A collapsible keyboard support tray comprising:

a deck having leg assemblies;

said deck further comprises a cutout for a receiving base in a collapsed mode;

said leg assemblies each further comprising:

a base and a riser functioning to adjust a height of the deck above a support surface;

said riser further comprising:

a sliding panel having adjustment holes for a locking handle on the base to engage the sliding panel, and a hinge functioning to fold the riser under the deck in the collapsed mode;

a keyboard support tray having a hinge functioning to maintain a top surface of the keyboard support tray approximately ½ inch below the deck and at an approximate 25° negative angle away from a user;

a wrist rest removably mounted atop the deck functioning to allow a 180 degree angle from a user's hands to his forearm; and a telescoping support bar having a locking lever functioning to stabilize the leg assemblies and fold under the deck in the collapsed mode.

* * * * *